US009327180B2

(12) United States Patent
Adamczewski et al.

(10) Patent No.: US 9,327,180 B2
(45) Date of Patent: May 3, 2016

(54) GLIDING OR ROLLING BOARD

(75) Inventors: David Adamczewski, Annecy (FR); Henri Rancon, Annecy (FR)

(73) Assignee: SALOMON S.A.S., Metz-Tessy (FR)

( * ) Notice: Subject to any disclaimer, the term of this patent is extended or adjusted under 35 U.S.C. 154(b) by 2210 days.

(21) Appl. No.: 11/642,718

(22) Filed: Dec. 21, 2006

(65) Prior Publication Data

US 2007/0170694 A1 Jul. 26, 2007

(30) Foreign Application Priority Data

Jan. 25, 2006 (FR) ..... 06.00693

(51) Int. Cl.
*A63C 5/00* (2006.01)
*A63C 5/04* (2006.01)
*A63C 5/03* (2006.01)

(52) U.S. Cl.
CPC ..... *A63C 5/003* (2013.01); *A63C 5/0405* (2013.01)

(58) Field of Classification Search
CPC ..... A63C 5/03; A63C 5/00; A63C 5/003
USPC ..... 280/601, 602, 607, 609, 610, 14.21, 280/14.22, 14.24
See application file for complete search history.

(56) References Cited

U.S. PATENT DOCUMENTS

| | | | | |
|---|---|---|---|---|
| 4,974,868 | A * | 12/1990 | Morris | 280/609 |
| 5,397,150 | A * | 3/1995 | Commier et al. | 280/607 |
| 6,352,268 | B1 * | 3/2002 | Peart | 280/14.21 |
| 6,382,658 | B1 * | 5/2002 | Stubblefield | 280/609 |
| 6,394,483 | B2 * | 5/2002 | Stubblefield | 280/602 |
| 6,499,758 | B1 * | 12/2002 | Fournier | 280/609 |
| 7,341,271 | B2 * | 3/2008 | Bunter | 280/602 |
| 2001/0052679 | A1 * | 12/2001 | Stubblefield | 280/14 |
| 2003/0094777 | A1 * | 5/2003 | Fournier | 280/14.22 |
| 2004/0032113 | A1 | 2/2004 | Rancon et al. | |
| 2004/0084878 | A1 | 5/2004 | Adamczewski | |
| 2004/0135327 | A1 | 7/2004 | Bunter | |
| 2004/0150190 | A1 | 8/2004 | Marion et al. | |
| 2005/0140117 | A1 * | 6/2005 | Spanier et al. | 280/602 |

FOREIGN PATENT DOCUMENTS

| | | |
|---|---|---|
| EP | 1 374 956 A1 | 1/2004 |
| EP | 1 405 657 A1 | 4/2004 |
| EP | 1 440 712 A1 | 7/2004 |
| FR | 2 804 336 A1 | 8/2001 |

* cited by examiner

*Primary Examiner* — Joseph Rocca
*Assistant Examiner* — Travis Coolman
(74) *Attorney, Agent, or Firm* — Greenblum & Bernstein, P.L.C.

(57) ABSTRACT

A gliding or rolling board, having a length measured along a longitudinal direction between a first end and a second end, a width measured along a transverse direction between a first slide and a second slide, and a height measured between a bottom and a top, the board including a first zone for receiving a foot or a boot, and a second zone for receiving a foot or boot. Between the receiving zones, the board includes a first flexing zone located toward the first receiving zone, as well as a second flexing zone located toward the second receiving zone.

12 Claims, 2 Drawing Sheets

GLIDING OR ROLLING BOARD

CROSS-REFERENCE TO RELATED APPLICATION

This application claims priority under 35 U.S.C. §119 of French Patent Application No. 06.00693, filed on Jan. 25, 2006, the disclosure of which is hereby incorporated by reference thereto in its entirety.

BACKGROUND OF THE INVENTION

1. Field of the Invention

The invention relates to the field of gliding or rolling boards adapted to the practice of snowboarding, surfboarding, skiing, water skiing, skateboarding, or the like.

2. Description of Background and Relevant Information

Conventionally, a board has a length measured in a longitudinal direction between a first end and a second end, a width measured in a transverse direction between a first edge and a second edge, and a height measured between a bottom and a top. The board also includes a first and second zones for receiving a foot, a boot, or a device for retaining the foot or the boot on the board.

To steer the board, a user applies biasing forces to it. This is especially the case in snowsurfing or snowboarding.

In this field, the rider's feet are both retained on the board by means of the bindings, in front and rear receiving zones, respectively. Each foot is oriented in a substantially transverse direction relative to the board. This enables the rider to be supported transversely with the heels or toes more easily.

Generally speaking, the rider prefers the board to glide in the longitudinal direction that is the most comfortable for him/her. Therefore, with respect to the preferred longitudinal gliding direction, one foot is chosen as the front foot and the other as the rear. By analogy, one end of the board is considered the front end, or nose, and the other end the rear end, or tail. Likewise, one binding zone is considered the front zone and the other one the rear zone.

The rider can perform acrobatic maneuvers, including jumps. One of them, called an "ollie", involves lifting the board off the ground by initially pressing down on one of its ends, typically the rear end, so as to jump in the preferred longitudinal gliding direction.

To perform an ollie, the rider flexes the board and offsets the center of gravity of his/her body toward the tail.

The flexing of the board is achieved by the action of the legs, so that the center of curvature is located toward the top. The flexing is to be understood as being a reversible elastic deformation of the board along a transverse axis of the board. This elastic deformation corresponds to an energy accumulation by the board. The flexing, combined with the offset of the center of gravity, initially allows the front end of the board to be lifted while the rider presses down on the rear end, i.e., on the tail. While the rear is being pressing down, some energy is accumulated by the flexional deformation of the rear end. This deformation completes the flexing. Then, the rider brings his/her center of gravity back towards the front end, or nose, and allows the board to recover its initial shape by releasing the accumulated energy. Consequently, at that time, the rear end is in turn lifted. When the two ends are lifted, that is, away from the ground, the board is entirely raised from the ground.

To facilitate a jump of this type, or ollie, it is known to reduce the height of the board between the receiving zones. The height reduction locally reduces the transverse cross section of the board, thereby creating a flexing zone, or flex point, in the board. The reduced height enables the board to flex, i.e., to bend more easily. Indeed, the flexional strength along a transverse axis is less in the area where the height is reduced. Therefore, the board bends more easily.

In a conventional board, the smallest transverse cross section is positioned substantially halfway between the receiving zones, as is the flex point of the board. However, this configuration makes it difficult to perform an ollie. The zone that enables the board to flex most easily is relatively distant from the position of the rider's feet. Consequently, the force one must exert in order to flex the board is substantial. Therefore, performing a jump or other maneuver can tend to be difficult and tiring.

In order to perform a jump, such as an ollie, more easily, it has been proposed to bring the flexion-facilitating zone closer to a receiving zone, i.e., closer to the foot of the rider. More specifically, taking into account the gliding direction preferred by the individual rider, the reduced height zone has been proposed to be positioned in the vicinity of the zone for retaining the rear foot. Thereby, the rider is provided with a greater lever arm to cause the bending of the board with the front foot. In this regard, the lever arm is the distance between the zone facilitating the flexion of the board and the zone for retaining the front foot. Consequently, it is easier for the rider to perform a jump while gliding in his/her preferred direction.

As a result, however, it becomes difficult for the rider to perform jumps while gliding opposite to his/her preferred direction. In other words, the board facilitates jumps in only one direction of displacement, that is, in only one gliding direction.

SUMMARY OF THE INVENTION

The invention enables a rider to perform maneuvers and jumps more easily, particularly ollies, in both longitudinal gliding directions, that is, both the preferred direction and the direction opposite to the preferred direction.

The invention also provides a more versatile board.

More particularly to this end, the invention provides for a gliding or rolling board having a length measured along a longitudinal direction between a first end and a second end, a width measured along a transverse direction between a first edge and a second edge, and a height measured between a bottom and a top, the board including a first zone for receiving a foot or a boot, and a second zone for receiving a foot or a boot.

Between the receiving zones, the board includes a first flexing zone, located toward the first receiving zone, as well as a second flexing zone, located toward the second receiving zone.

The first flexing zone is close to the first receiving zone, whereas the second flexing zone is close to the second receiving zone.

This arrangement provides two lever arms for bending the board with the legs. One of the arms extends from the first flexing zone up to the second retaining zone, and the other extends from the second flexing zone up to the first retaining zone. Consequently, the rider can easily bend the board and lift either one of the ends, irrespective of his/her longitudinal direction of movement while riding the board.

The rider can therefore make his/her board store a significant amount of energy by bending, irrespective of the longitudinal maneuvering direction.

A resulting advantage is that the rider can perform maneuvers, including jumps, particularly jumps such as ollies, with the same ease in both directions of movement. A board of the invention, therefore, is more versatile than a board from the prior art.

BRIEF DESCRIPTION OF THE DRAWINGS

Other characteristics and advantages of the invention will be better understood from the description that follows, with reference to the annexed drawings showing, by way of a non-limiting embodiment, how the invention can be implemented, and in which.

DETAILED DESCRIPTION OF THE INVENTION

Figure 1:
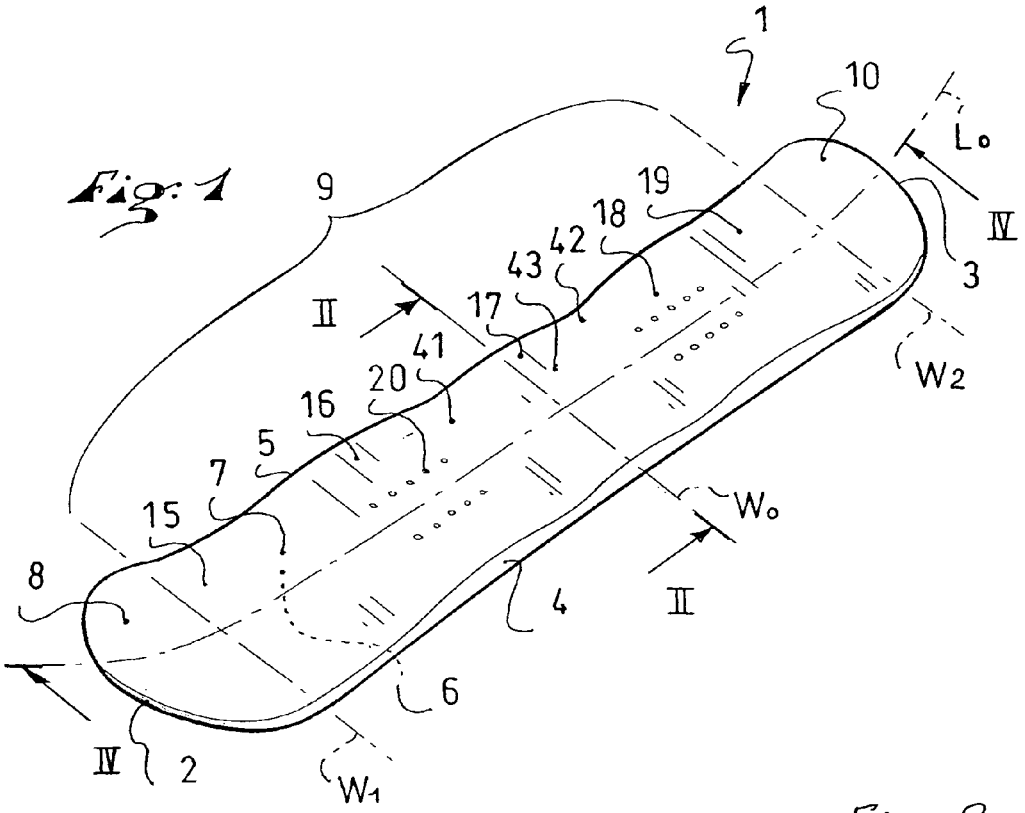
FIG. 1 is a perspective view of a board according to an embodiment of the invention.

Although the illustrated embodiment discussed below and illustrated in the drawings relates to a snowboard, the invention encompasses boards adapted for the practice of other sports, including those mentioned above.

The embodiment described in greater detail below is presented with reference to FIGS. 1 to 5.

In a known manner, as shown in FIG. 1, a snowboard 1 has a length measured along a longitudinal direction between a first end 2 and a second end 3, i.e., between the nose and the tail of the board. The longitudinal direction is marked by the central longitudinal axis Lo. The first end 2 and the second end 3 are both rounded, but they could alternatively have a different shape, such as a pointed tip or fin. The board 1 also has a width measured along a transverse direction between a first lateral side 4 and a second lateral side 5, as well as a height measured between a gliding surface 6, or base, and a receiving surface 7, or top. The transverse direction is marked by the median transverse axis Wo. The peripheral contour of the board includes the ends and the sides. For each side, the sidecut dimension, or sidecut radius, according to the illustrated embodiment, is concave with respect to the longitudinal direction Lo.

The transverse direction is perpendicular to the longitudinal direction and parallel to the gliding surface 6.

The board 1 also includes, from the first end 2 to the second end 3, a first end zone 8, a first contact line W1, a central zone 9, a second contact line W2, and a second end zone 10. The central zone 9 itself successively includes, between the contact lines W1, W2, a first intermediate zone 15, a first retaining zone 16, a second intermediate zone 17 located in the area of the median axis Wo, a second retaining zone 18, and a third intermediate zone 19.

Each retaining zone 16, 18 is adapted to receive a device for retaining a user's foot, i.e., the boot bindings. The devices (not shown) can be affixed to the board 1 by means such as screws. To this end, each retaining zone 16, 18, is provided with threaded openings 20. Examples of such devices are disclosed in U.S. Pat. No. 6,068,283 and U.S. Pat. No. 6,676,152, both of which are commonly owned herewith.

Each of the contact lines W1, W2 extends transverse, or substantially transverse, to the board 1, in the area of which the gilding surface 6 touches a flat surface when the board 1 rests on the surface without outside influence.

The general appearance of the board 1 is that of an elongated plate. According to the embodiment shown, the bottom 6, or base, is slightly concave between the contact lines W1, W2. The bottom 6 has an inner hollow or roundness, or camber, which extends along the central zone 9, substantially from the first intermediate zone 15 to the third intermediate zone 19. In the illustrated embodiment, the roundness has a uniform geometry. The top 7, however, has two slight prominences shown as two thicker portions in the retaining zones 16, 18. Furthermore, the board width is slightly reduced between the sides 4, 5, in the area of the second intermediate zone 17.

Figure 2:
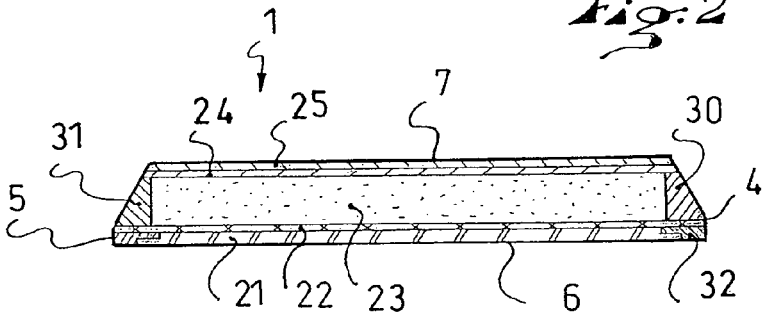
FIG. 2 is a cross section along line II-II of FIG. 1.

The height of the board 1 is shown in cross section in FIG. 2.

From the gliding surface 6 to the receiving surface 7, i.e., from the base to the top, the board 1 has a soleplate 21, a first reinforcement 22, a core 23, a second reinforcement 24, and a protective layer 25.

Depending on the type of board, the number of reinforcements can be modified and be less or more than two. In addition, the board can have no reinforcement and/or no protective layer.

As a non-limiting example, the soleplate 21 is made of a plastic material containing polyethylene (PU). Also as a non-limiting example, the protective layer 25 is made of plastic material containing acetyl-butadlene-styrene (ABS).

Figure 3:
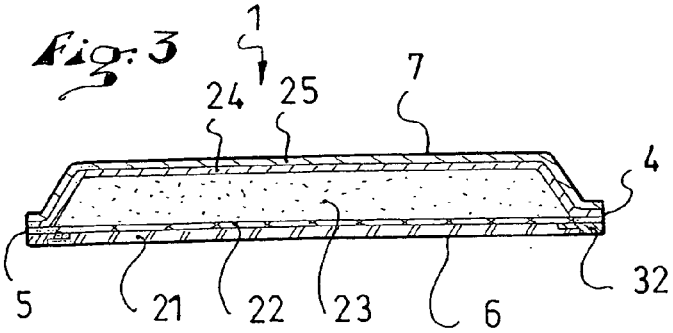
FIG. 3 is a cross section, similar to that of FIG. 2, for a constructional alternative of the embodiment.
Figure 4:
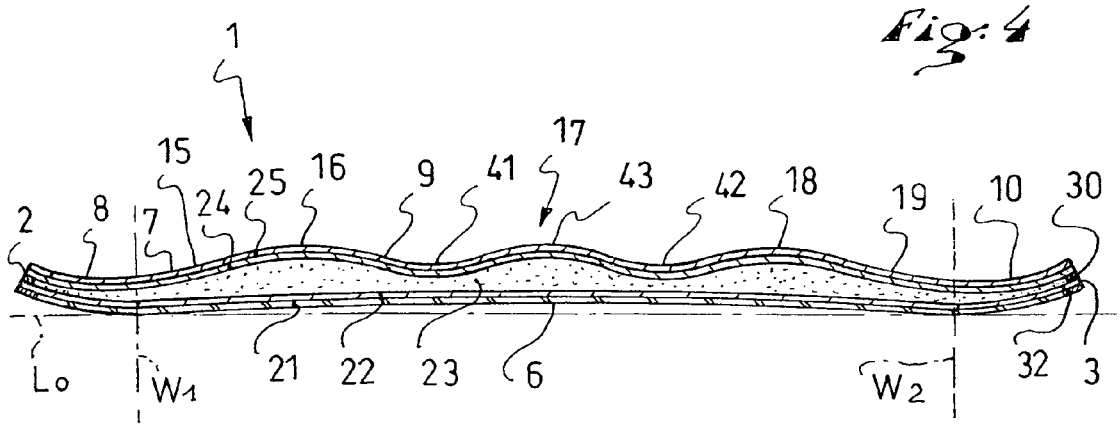
FIG. 4 is a cross section along IV-IV of FIG. 1.
Figure 5:
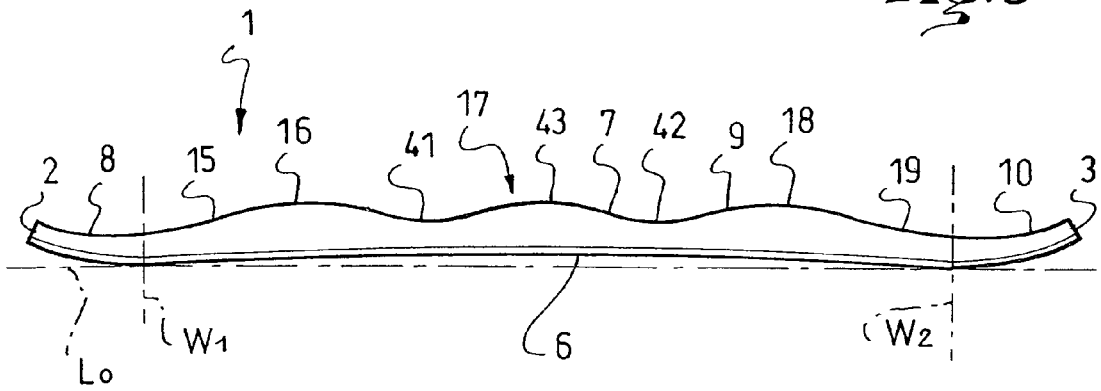
FIG. 5 is a side view of the board of FIG. 1.

According to the particular illustrated embodiment, each of the reinforcements 22, 24 is made from resin-impregnated fibers. The fibers can be made of any material or any combination of materials, such as glass, carbon, aramid, metal, or the like. The core 23 has a main body, giving it its general appearance, as shown in FIGS. 2, 3, and 4. The main body includes, for example, wood, synthetic material foam, and/or any other material.

The reinforcements 22, 24 and the core 23 form a sandwich panel, which extends along at least 50% of the surface or length of the board and, in a particular embodiment, substantially over the entire surface or length.

The board 1 also includes a first lateral sidewall 30 located in the area of the first lateral side 4 as well as a second lateral sidewall 31 located in the area of the second lateral side 5. This sidewall construction provides the board with a box-type structure. A sidewall 30, 31 is made from, or includes, for example, a synthetic material such as acetyl-butadiene-styrene.

Alternatively, as shown in FIG. 3, a construction, which is a variation within the scope of the invention, can be provided. This alternative excludes the sidewalls. The first and second reinforcements 22, 24 are directly connected. This cap construction provides the board with a shell-type structure.

Any other alternative structure is also encompassed by the invention. For example, a portion of the board can be of the box type while another portion is of the shell type, such as a half cap construction by which the upper reinforcement 24 comes down at the sides of the board not to the point of touching the bottom reinforcement 22, but to the point of touching the top of a sidewall that is reduced in height with respect to the sidewalls 30, 31 shown in FIG. 2.

A peripheral edge 32 that runs along the soleplate 21 is also provided. The edge 32 is continuous, although it could also be segmented, or not extend over the entire periphery. For example, it could include a portion located along the first side 4 and a portion located along the second side 5, i.e., in the areas to constitute the "effective edge" which typically engage the snow when executing a turn, for example. The edge 32, in a particular embodiment, includes a metal alloy, such as steel, or the like.

According to the invention, between the receiving or retaining zones 16, 18, the board 1 includes a first flexing zone 41, located toward the first receiving zone 16, as well as a second flexing zone 42, located toward the second receiving zone 18. More specifically, the first flexing zone 41 is located between the first receiving zone 16 and the median transverse axis Wo, and the second flexing zone 42 is located between the second receiving zone 18 and the median transverse axis Wo.

If the rider offsets his/her center of gravity toward the first end 2, he/she can easily push with one leg in the first retaining zone 16 while pulling with the other leg in the area of the second retaining zone 18. The first flexing zone 41 facilitates the bending of the board 1, so that the center of curvature is turned toward the top 7. The lever arm extends from the first flexing zone 41 up to the second retaining zone 18.

Conversely, if the rider offsets his/her center of gravity toward the second end 3, he/she can easily press with one leg in the second retaining zone 18 while pulling with the other leg in the area of the first retaining zone 16. The second flexing zone 42 facilitates the bending of the board 1, so that the center of curvature is turned toward the top 7. The lever arm extends from the second flexing zone 42 up to the first retaining zone 16.

Therefore, the rider can lift either of the ends of the board with the same ease. Consequently, it is as easy to jump in each longitudinal gilding direction, i.e., whether the rider leads with the first end 2 or the second end 3.

According to the embodiment of the invention illustrated in FIGS. 1 to 5, each of the first and second flexing zones 41, 42 has a localized reduction in the height of the board. To obtain the height reduction, the thickness of the core 23 is reduced in the area of each of the flexing zones 41, 42. Consequently, the height of the board is greater in a connecting zone 43 than in the flexing zones 41, 42, the connecting zone linking the flexing zones 41, 42 to one another. The second intermediate zone 17 includes the first flexing zone 41, the connecting zone 43, and the second flexing zone 42.

The height of the board 1 is greater in the first retaining zone 16 than in the first flexing zone 41, and in the second retaining zone 18 than in the second flexing zone 42.

Therefore, seen from the side, the board 1 has three peaks 16, 43, 18 between the contact lines W1, W2. These peaks are successively the first receiving or retaining zone 16, the connecting zone 43, and the second retaining zone 18. The valleys 41, 42 separating the peaks are the first and second flexing zones 41, 42. Each peak 16, 18 of the receiving zones is provided to one of the receive boot retaining devices and, therefore, has an adequate surface, that is, for example, approximately planar or flattened.

As a non-limiting example, the height of the board in the area of a retaining zone 16, 18 or of the connecting zone 43 is between 7 and 20 mm. The height in the area of the flexing zones 41, 42 is between 5 and 15 mm.

In a retaining zone 16, 18, the height of the board is substantially constant along the transverse direction Wo. In a flexing zone 41, 42 and in the connecting zone 43, each transverse cross section of the board has a substantially constant height. This gives the board transverse uniformity.

The height of the board continuously and progressively varies from the first to the second retaining zone 16, 18. Therefore, longitudinally, the top 7 is concave in the first flexing zone 41, convex in the connecting zone 43, and concave in the second flexing zone 42.

Non-continuous and/or non-progressive height variations can alternatively be provided. For example, a flexing zone could include a transverse groove.

Each flexing zone 41, 42 is oriented along the transverse direction Wo of the board 1. In other words, the points where the height of the board is the smallest, that is, the bottom of the valleys of the flexing zones 41, 42, are contained in a transverse cross section. Therefore, the board 1 is stable when the rider is supported during jumps or other maneuvers.

Alternatively, other variations for the shapes of the valleys of the flexing zones 41, 42 can be provided.

In a non-limiting manner, the heights of the first and second retaining zones 16, 18 are the same. The maximum height of the connecting zone is substantially equal to the height of the retaining zones 16, 18.

The zones 16, 18, 43 could alternatively be provided to have different heights relative to one another.

The invention is implemented using materials and according to techniques known to one having ordinary skills in the art.

The invention is not limited to the particular embodiments described above and includes all the technical equivalents fall within the scope of the claims that follow.

In particular, a flexing zone can be produced by mechanical weakening or interruption of a reinforcement, such as a discontinuation in the length of such reinforcement(s). The mechanical weakening can be obtained by locally reducing the thickness of the reinforcement, without necessarily varying the thickness of the board.

The height of the board must not always vary in the area of a flexing zone.

A valley between peaks can alternatively be filled between successive peaks by a packing or damping element.

Although the board illustrated in the drawing is substantially symmetrical along a central transverse axis, at least between the contact lines W1, W2, it could be provided not to be symmetrical.

The invention applies to any type of gliding or rolling board for which similar or equivalent problems arise, as described above.

The invention claimed is:

1. A gliding or rolling board comprising:

a first end and a second end, the board having a length extending longitudinally between said first and second ends;

a first side and a second side, the board having a width extending transversely between said first and second sides;

a top and a bottom, the board having a height extending between the top and the bottom;

a first receiving zone and a second receiving zone, each of said first and second receiving zones adapted to receive a foot or a boot of a rider so that both of two legs of the rider can be simultaneously contained within the width of the board during use of the board with the feet or boots of the rider angled relative to the longitudinal;

between said first and second receiving zones, the board further comprising:

a first board flexing zone located closer to the first receiving zone than to the second receiving zone;

a second board flexing zone located closer to the second receiving zone than to the first receiving zone;

the first board flexing zone being located between the first receiving zone and a median transverse axis of the board;

the second board flexing zone being located between the second receiving zone and the median transverse axis of the board;

the height of the board in each of the first and second board flexing zones being reduced relative to the height of the board in the first and second receiving zones;

a connecting zone longitudinally connecting the first and second board flexing zones;

the height of the board in the connecting zone being greater than the height of the board in either of the first and second board flexing zones.

2. A gliding or rolling board according to claim 1, wherein:

the board further comprises a core;

the core has a reduced thickness relative to a thickness of a longitudinally adjacent portion of the core.

3. A gliding or rolling board according to claim 1, wherein:

the board has two longitudinally spaced apart contact lines;

the board has three peaks longitudinally between the two contact lines;

said three peaks are constituted successively by the first receiving zone, the connecting zone, and the second receiving zone.

4. A gliding or rolling board according to claim 1, wherein:

the board has a substantially constant height in transverse cross section in at least one of the first and second flexing zones.

5. A gliding or rolling board according to claim 1, wherein:

the height of the board continuously and progressively varies from the first receiving zone up to the second receiving zone.

6. A gliding or rolling board according to claim 1, wherein:

the top of the board is concave in the first flexing zone, convex in the connecting zone, and concave in the second flexing zone.

7. A gliding or rolling board according to claim 1, wherein:

the board has two longitudinally spaced apart contact lines;

the board is substantially symmetrical on either side of a central transverse cross section, between the contact lines.

8. A gliding or rolling board according to claim 1, wherein:

the height in each of the first and second receiving zones is between 7 and 20 millimeters;

the height in each of the first and second flexing zones is between 5 and 15 millimeters.

9. A gliding or rolling board according to claim 1, wherein:

the height of the board in each of the first and second board flexing zones is reduced relative to the height of the board in a respective longitudinally adjacent portion of the board;

the height in the connecting zone and in each of the first and second receiving zones is between 7 and 20 millimeters;

the height in each of the first and second flexing zones is between 5 and 15 millimeters.

10. A gliding or rolling board according to claim 1, wherein:

the first and second board flexing zones are longitudinally spaced apart.

11. A gliding or rolling board according to claim 1, wherein:

the board is structured and arranged for use while retaining a pair of feet or a pair of boots on the board without supporting either of said pair of feet or either of said pair of boots over said median transverse axis.

12. A gliding or rolling board according to claim 1, wherein:

each of the first and second receiving zones is adapted to support the foot or the boot in a transverse orientation on the board.

* * * * *